US005345703A

United States Patent [19]

Farrington et al.

[11] Patent Number: 5,345,703

[45] Date of Patent: Sep. 13, 1994

[54] STEAM IRON SEAL WITH TANGENTIAL FLOW FOR SURGE

[75] Inventors: Richard I. Farrington, Seymour, Conn.; David Jalbert, Coventry, R.I.

[73] Assignee: Black & Decker, Inc., Newark, Del.

[21] Appl. No.: 132,416

[22] Filed: Oct. 6, 1993

[51] Int. Cl.[5] ..... D06F 75/18; D06F 75/22; D06F 75/26

[52] U.S. Cl. ..... 38/77.5; 38/77.7; 38/77.83

[58] Field of Search ..... 38/74, 77.1, 77.5, 77.8, 38/77.82, 77.83, 77.7, 88; 219/245, 251, 253

[56] References Cited

U.S. PATENT DOCUMENTS

| | | | |
|---|---|---|---|
| 3,407,522 | 10/1968 | Jepson et al. | 38/77.83 X |
| 3,849,916 | 11/1974 | Davidson et al. | 38/77.83 |
| 3,872,613 | 3/1975 | Davidson et al. | 38/77.83 |
| 4,433,231 | 2/1984 | Balchunas | 219/253 |
| 4,656,763 | 4/1987 | Kawasaki et al. | 38/77.7 X |

FOREIGN PATENT DOCUMENTS

| | | | |
|---|---|---|---|
| 2458831 | 6/1975 | Fed. Rep. of Germany | 38/77.83 |
| 0054079 | 11/1985 | Japan | 38/77.83 |

*Primary Examiner*—Clifford D. Crowder
*Assistant Examiner*—Ismael Izaguirre
*Attorney, Agent, or Firm*—Barry E. Deutsch

[57] ABSTRACT

An electric iron includes a soleplate, a soleplate cover connected to the soleplate, a housing connected to the soleplate, and a water tank associated with the housing. The soleplate and soleplate cover are spaced to form a surge chamber therebetween. The soleplate cover includes a first flow opening communicating the water tank with the surge chambers. A flow control member delivers water from the tank to the surge chamber. A seal overlies the first flow opening and includes a first portion in sealing engagement with the first flow opening. The portion of the seal includes a first leg extending through the flow opening below the lower surface of the cover. The leg includes a nozzle for directing water from the tank into the surge chamber in a tangential flow path relative to the lower surface of the cover. The nozzle directs the water towards a temperature sensing element used to control the temperature of the soleplate heater.

8 Claims, 3 Drawing Sheets

STEAM IRON SEAL WITH TANGENTIAL FLOW FOR SURGE

BACKGROUND OF THE INVENTION

1. Field of the Invention

This invention relates to electric irons and in particular to a seal used to seal the surge chamber formed in the soleplate.

2. Description of the Related Art

The typical modern steam iron generally includes a "surge" function. The surge function increases the speed and effectiveness of the steam iron in removing wrinkles from certain fabrics by enabling the user of the iron to selectively generate relatively large quantities of steam at intermittent times in the ironing process.

Typically, a surge chamber is formed in the soleplate between the top surface of the soleplate and the bottom surface of the soleplate cover.

To generate the relatively large quantities of steam at intermittent times, the iron includes a separate surge control which allows the user to intermittently supply a relatively large quantity of water into the surge chamber from the water reservoir when the surge of steam is desired. It has been found that the temperature sensing element controlling the supply of electrical energy to the soleplate heater should be located in relatively close proximity to the portion of the surge chamber which directly receives the flow of water from the water reservoir. The relatively large flow of water from the water reservoir into the surge chamber immediately cools the portion of the soleplate onto which the water drops. However, if the temperature sensing element is remote from the soleplate surface cooled by the water entering into the surge chamber, the element will not sense the decrease in the soleplate temperature for some period of time. This results in the temperature of the soleplate being lowered below the desired working temperature.

Due to design and space limitations, it is not always possible to place the temperature sensing element as desired in close proximity to the portion of the surge chamber receiving the water from the reservoir. Accordingly, it is an object of this invention to manufacture an electric iron having a surge function including a seal member about the surge opening formed in the soleplate cover; the member directs the water flowing into the surge chamber towards the temperature sensing element controlling the supply of electric power to the soleplate heater.

SUMMARY OF THE INVENTION

The foregoing object and other objects of the invention are attained in an electric iron having a soleplate, a soleplate cover attached to the soleplate, a housing connected to the soleplate and a water reservoir or tank associated with the housing and having a water inlet and at least two water outlets. One of the water outlets is connected to a surge chamber formed in the soleplate between the top surface of the soleplate and the bottom surface of the soleplate cover. Flow control means delivers water from the water tank into the surge chamber. A first flow opening is formed in the soleplate cover for flow of water from the water tank into the surge chamber. Seal means overlies the flow opening and includes a first portion in sealing engagement with the flow opening and a second portion including a leg extending through the flow opening below the lower surface of the cover. The leg of the seal means portion includes means forming a nozzle for directing water from the tank into the surge chamber in a tangential flow path relative to the lower surface of the cover. A temperature sensing element is mounted in proximity to the surge chamber and controls the supply of electrical energy to the soleplate heater. The nozzle of the seal means directs the water from the tank towards the temperature sensing element.

DESCRIPTION OF THE PREFERRED EMBODIMENT

Figure 1:
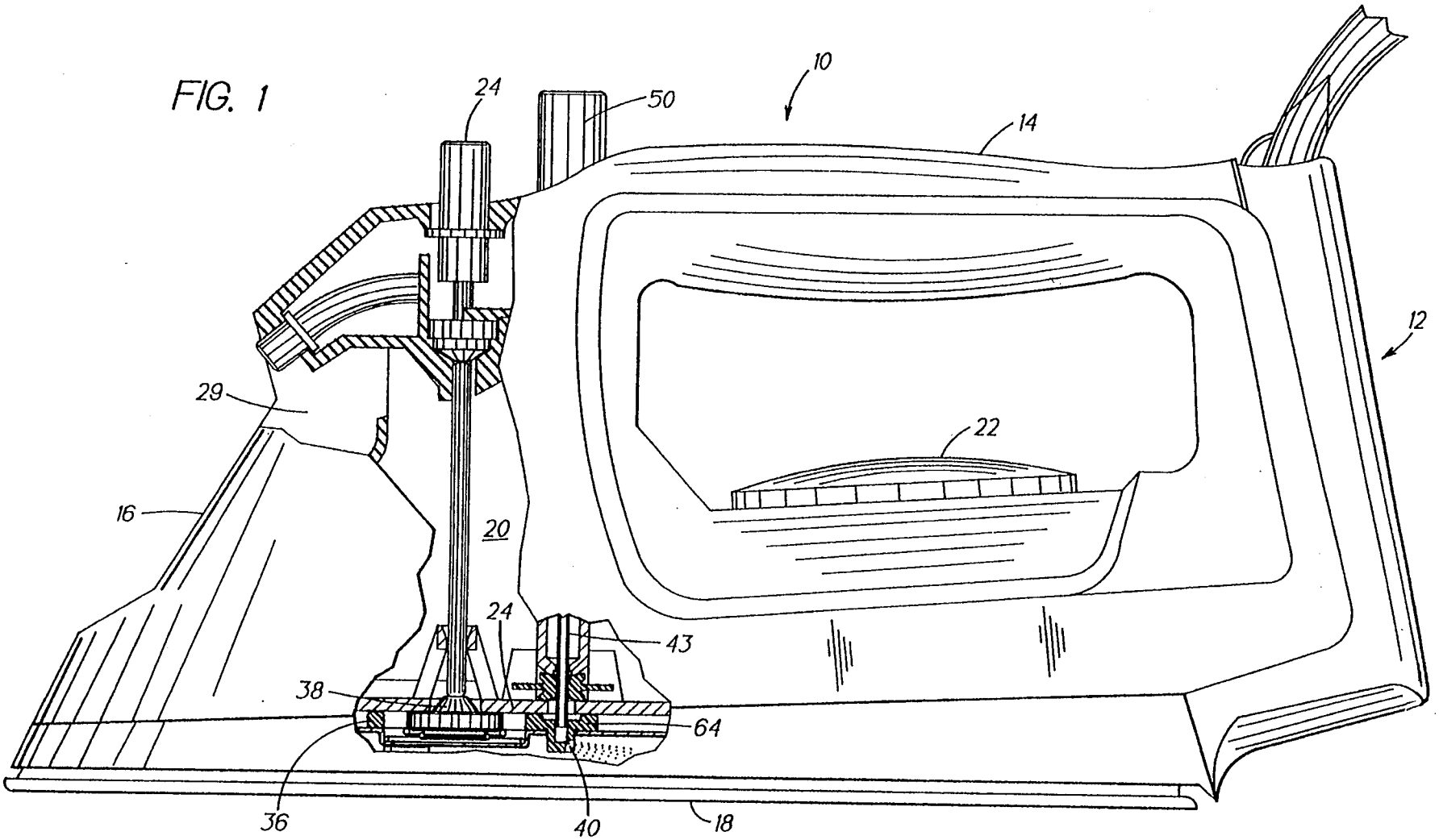
FIG. 1 is a side elevational view, partially in cross section, of an electric steam iron incorporating a seal in accordance with the present invention.
Figure 2:
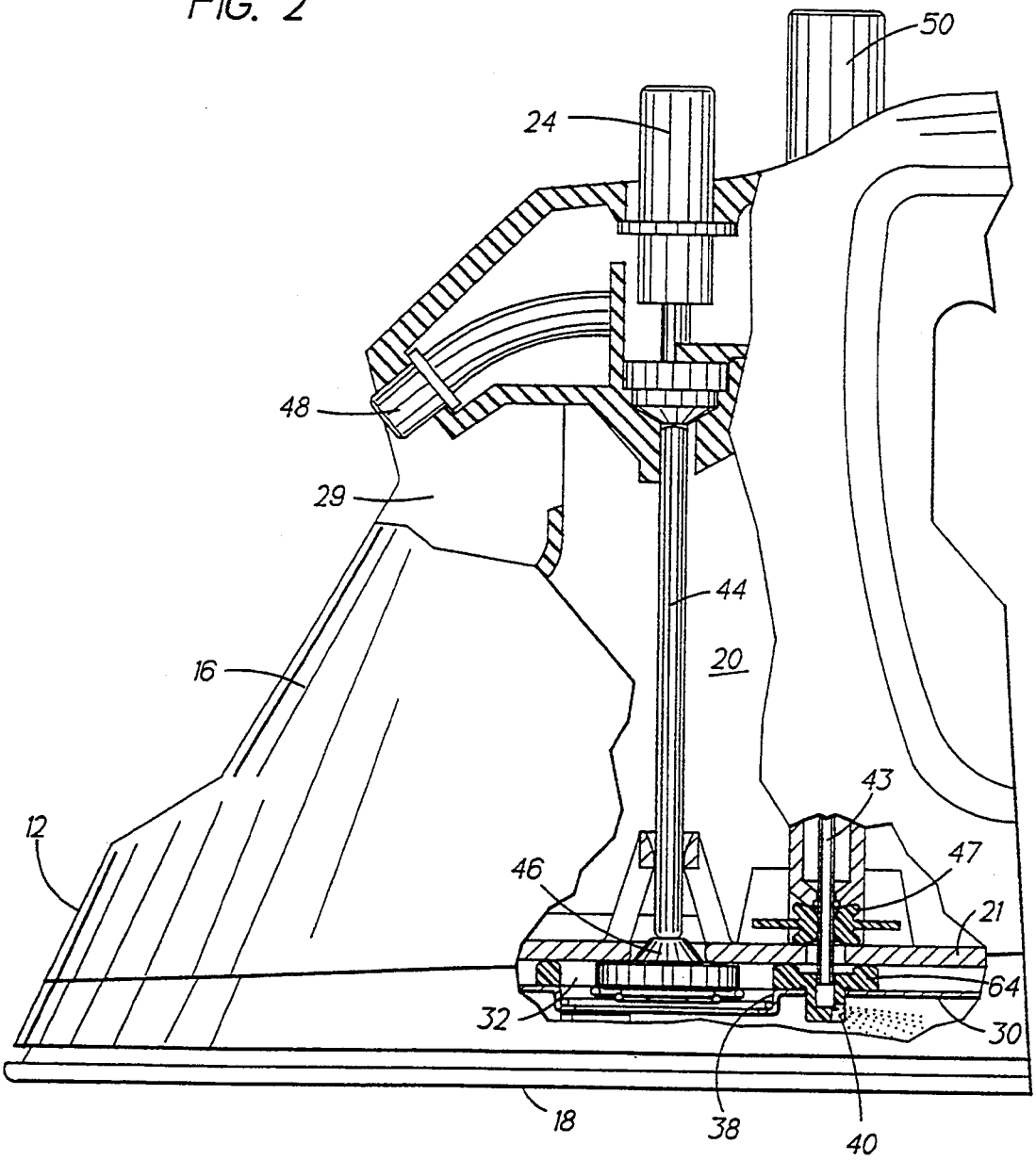
FIG. 2 is an enlarged partially sectional view of the front portion of the iron illustrated in FIG. 1.

Referring now to the various figures of the drawing, there is disclosed a preferred embodiment of the present invention. In referring to the various figures, like numerals shall refer to like parts.

Referring specifically to FIG. 1, there is disclosed an electric steam iron generally designated by the reference numeral 10. Steam iron 10 includes a body portion 12, a handle 14 for manipulating the steam iron, a forward or nose portion 16, and an electrically heated soleplate 18. A water containing reservoir or tank 20 is formed within body portion 12 of steam iron 10 and contains a supply of water for the generation of steam. The reservoir is located above skirt 21 of iron 10. As is well known in the art, steam iron 10 includes a fillport 29 by which reservoir 20 is periodically filled by the user. Reservoir 20 may include a transparent or translucent window (not shown) by which the level of water in the reservoir can be gauged by the user. Iron 10 is provided with a user—operable temperature control 22 to regulate the electric power provided to soleplate 18 and a steam flow control knob 24 which controls the amount of steam issued from steam apertures 25, shown in FIG. 3, in soleplate 18 as is conventional in the art. Control 22 is connected to a thermostat 27 that periodically opens and closes an electric circuit to supply power to soleplate 18 and thus establish the ironing temperature of the soleplate. Thermostat 27 is mounted on post 52 formed on the upper surface of soleplate 18. Thermostat 27 includes bimetallic sensing element 54 which overlies steam chamber cover 30 and is connected to second post 56 extending upwardly from the top surface of soleplate 18. The soleplate includes a generally U-shaped heater 19 connected via terminals 17 to the source of electrical energy.

Soleplate 18 includes an interior surface portion 28 enclosed by steam chamber cover 30 to define a steam chamber 32 in which water from reservoir 20 is flashed to steam. Steam chamber 32 is bounded by wall member 34. Rear portion 34' of wall member 34 is vertically lower than the front portion to permit steam formed in chamber 32 to flow therefrom over the top surfaces of lower portion 34' of wall member 34 and heater 19 into passageway 36. Passageway 36 delivers the steam to the plurality of steam apertures 25 in communication therewith.

Steam chamber cover 30 includes a relatively large opening 38 overlying steam chamber 32. The cover further includes a relatively smaller opening 40 communicating with surge chamber 42 formed in the soleplate. Cover 30 includes a third opening 41 through which the top portion of mounting post 56 extends. Thermostat 27 is connected by suitable means (not shown) to control 22.

The flow of water from reservoir 20 into steam chamber 32 is controlled by actuation of knob 24. Knob 24 is connected via rod 44 to a metering valve 46. When steam flow control knob 24 is rotated, rod 44 moves axially to regulate the operation of the metering valve to control the flow of water from reservoir 20 through opening 38 and then into chamber 32.

Iron 10 may further include a water spray nozzle 48 mounted at the forward or nose portion 16. Spray nozzle 48 enables the user of the iron to emit a spray of water droplets onto the object to be ironed which is positioned in the path of movement of the iron. The spray function is used when ironing certain fabrics.

As indicated previously, soleplate 18 includes surge chamber 42. Under the user's control, a jet of water is suddenly introduced into the surge chamber to produce a relatively large quantity of steam. The surge function increases the speed and effectiveness of the steam iron in removing wrinkles from certain fabrics by enabling the user of the iron to selectively generate relatively large quantities of steam at intermittent times in the ironing process.

A control knob 50 is mounted at the top of housing 12 and provides the user with the ability to control a jet of water supplied from reservoir 20 into surge chamber 42 via conduit 43. A seal 47 prevents water leakage between water reservoir 20 and skirt 21 of iron 10. A suitable control for delivering water into surge chamber 42 is disclosed in U.S. Pat. No. 5,136,796, issued Aug. 11, 1992 and assigned to the same assignee as the assignee hereof.

Figure 4:
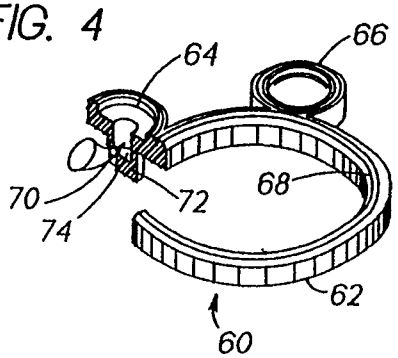
FIG. 4 is a perspective, partially sectional view of the seal illustrating details thereof.
Figure 3:
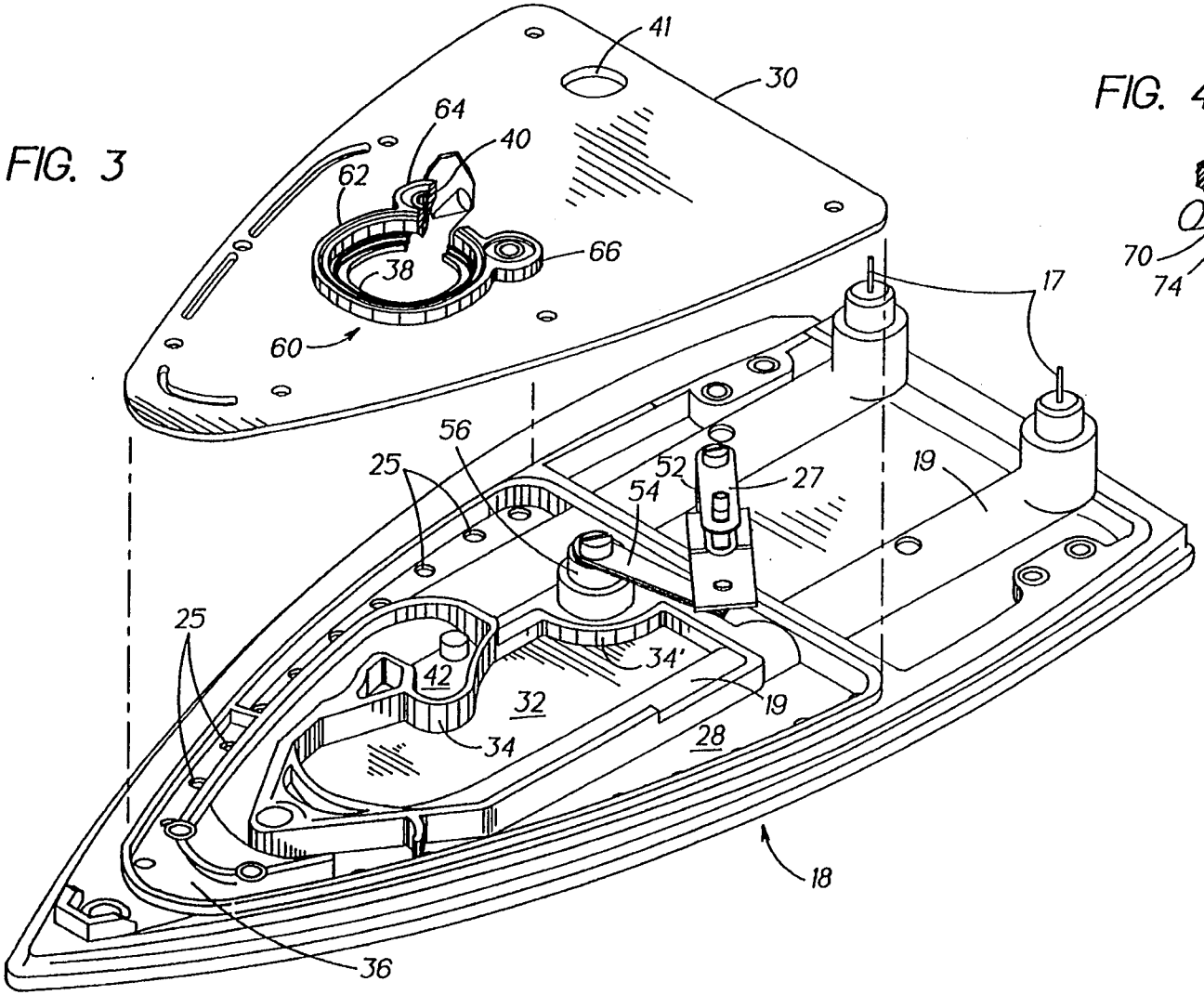
FIG. 3 is an exploded plan view partially in section, of the soleplate cover and soleplate illustrating the seal of the present invention.

Openings 38 and 40 in cover 30 must be sealed to prevent leakage of water as the water flows from reservoir 20 into steam chamber 32 and/or surge chamber 42. Referring specifically to FIGS. 3 and 4, there is shown a preferred embodiment of seal means 60 in accordance with the present invention. Seal means 60 preferably includes a first relatively large circular portion 62. Seal means 60 further includes a pair of circumferentially spaced relatively smaller circular portions 64 and 66. Portions 64 and 66 are connected to the relatively larger circular portion 62 to form ear-like protuberances. Although ear-like protuberances 64 and 66 are shown as being integral with relatively large portion 62, it should be specifically understood that the ear-like protuberances 64 and 66 may be formed separately from portion 62. As shall be more fully explained, it also should be understood that ear-like protuberance 66 may be eliminated without departing from the scope of the present invention.

Relatively large portion 62 of seal means 60 seals opening 38 while ear-like protuberance 64 seals opening 40. Portion 62 is generally ring-like and includes an opening 68 through which water flows from reservoir 20 through opening 38 underlying opening 68 into chamber 32. Ear-like protuberance 64 includes a relatively small diameter opening 70 which overlies opening 40 in cover 30. Water flows from reservoir 20 through openings 70 and 40 into surge chamber 42 when the user activates control 50 to obtain a surge of steam.

Ear-like protuberance 64 includes a downwardly extending leg-like portion 72 which extends through opening 40. Leg-like portion 72 extends below the lower surface of cover 30 and into surge chamber 32. Leg-like portion 72 includes a discharge flow opening 74 which directs the water supplied to surge chamber 42 in a tangential flow path relative to the lower surface of cover 30.

Discharge opening 74 directs the stream of water flowing into surge chamber 42 rearwardly towards bimetallic sensing element 54 of thermostat 27. Second post 56 is physically connected to element 54. Element 54 is thus responsive to temperature changes of post 56. The temperature of the portion of the soleplate adjacent post 56 will be lowered. By lowering the temperature of the portion of the soleplate adjacent post 56, sensing element 54 will sense a requirement for additional flow of electrical energy to heater 19. The foregoing is extremely important for proper operation of the iron under surge conditions. In the absence of directing the flow of water into the surge chamber towards the portion of soleplate 18 adjacent post 56, thermostat 27 will not accurately sense the cooling of the soleplate as the surge of water comes into contact therewith. In the absence of proper sensing of the lowered soleplate temperature under surge conditions, the thermostat will allow the soleplate temperature to cool below desired operating levels.

Ear-like protuberance 66 of seal means 60 is provided to balance the seal forces acting on seal means 60. In particular, the seal force acting on protuberance 66 balances the seal forces acting on protuberance 64. Protuberance 66 includes a downwardly extending leg portion (not shown) which is similar to leg-portion 72 and extends through a relatively small opening formed in cover 30. Although it is preferable to have second protuberance 66, it is not essential for satisfactory functioning of the invention. Protuberance 66 specifically may be eliminated if protuberance 64 is separate from seal portion 62.

Discharge opening 74 formed in leg 72 is tapered outwardly so that the stream of water discharged from the opening expands. It is believed that the expansion of the stream of water results in atomization thereof. Atomization of the water flowing into the surge chamber will enable the water to be converted to steam at a faster rate.

The seal means of the present invention permits a designer of an iron to place the thermostat in a position remote from the water inlet into the surge chamber without degrading the performance of the iron under surge conditions.

While a preferred embodiment of the present invention has been described and illustrated the invention should not be limited thereto but may be otherwise embodied within the scope of the following claims.

What is claimed is:

1. An electric iron comprising:

a soleplate having a top surface and a bottom surface;

a soleplate cover connected to the top surface of the soleplate including first and second fluid flow openings;

a housing connected to the soleplate cover;

said soleplate and soleplate cover including first means forming a steam chamber and second means forming a surge chamber;

a water tank located in the housing and having a first flow control water inlet and at least a pair of water outlets;

valve means controlling the flow of water from said water tank to said steam chamber through said first flow opening in said soleplate cover;

second flow control means for controlling the flow of water from the water tank to the surge chamber through said second flow opening in said soleplate cover;

seal means overlying said first and second flow openings including a first portion in sealing engagement with the first flow opening and a second portion in sealing engagement with the second flow opening, said second portion including a first leg extending through the second flow opening below a lower surface of the cover and having means defining a nozzle for directing water from said water tank into said surge chamber in a tangential flow path relative to the lower surface of the cover; and temperature sensing means in heat transfer relation with the soleplate and mounted in relatively close proximity to said surge chamber for regulating the temperature of the soleplate, said nozzle directing the water flowing through said second flow opening towards said temperature sensing element.

2. An electric iron in accordance with claim 1 wherein the first portion of said seal means is formed integral with the second portion.

3. An electric iron in accordance with claim 2 wherein the first portion comprises a relatively large diameter circular sealing member and the second portion comprises a relatively small diameter circular sealing member circumferentially joined to the large diameter circular sealing member.

4. An electric iron in accordance with claim 3 wherein the seal means includes a third portion connected to the first portion and spaced from the second portion and overlying a third fluid flow opening in said soleplate cover, said third portion including leg means extending through the third opening.

5. An electric iron in accordance with claim 2 wherein the seal means includes a third portion connected to the first portion and overlying a third opening in said soleplate cover, said third portion including leg means extending through the third opening.

6. An electric iron in accordance with claim 1 wherein the first portion comprises a relatively large diameter circular sealing member and the second portion comprises a relatively small diameter circular sealing member circumferentially joined to the large diameter circular sealing member.

7. An electric iron in accordance with claim 6 wherein the seal means includes a third portion connected to the first portion and spaced from the second portion and overlying a third opening in said soleplate cover, said third portion including leg means extending through the third opening.

8. An electric iron in accordance with claim 1 wherein the seal means includes a third portion connected to the first portion and overlying a third opening in said soleplate cover, said third portion including leg means extending through the third opening.

* * * * *